US009638184B2

(12) United States Patent
Ichihara

(10) Patent No.: US 9,638,184 B2
(45) Date of Patent: May 2, 2017

(54) AIR COMPRESSOR HAVING MECHANICAL GOVENOR WITH ENGINE SPEED RELIEF

(75) Inventor: Atsushi Ichihara, Ageo (JP)

(73) Assignee: UD TRUCKS CORPORATION, Ageo-shi (JP)

( * ) Notice: Subject to any disclaimer, the term of this patent is extended or adjusted under 35 U.S.C. 154(b) by 271 days.

(21) Appl. No.: 13/992,249

(22) PCT Filed: Nov. 15, 2011

(86) PCT No.: PCT/JP2011/006360

§ 371 (c)(1),
(2), (4) Date: Jun. 7, 2013

(87) PCT Pub. No.: WO2012/077282

PCT Pub. Date: Jun. 14, 2012

(65) Prior Publication Data

US 2013/0259719 A1 Oct. 3, 2013

(30) Foreign Application Priority Data

Dec. 7, 2010 (JP) ..... 2010-272370

(51) Int. Cl.
*F04B 41/02* (2006.01)
*F04B 39/08* (2006.01)
(Continued)

(52) U.S. Cl.
CPC ..... *F04B 41/02* (2013.01); *F04B 17/05* (2013.01); *F04B 39/08* (2013.01); *F04B 39/102* (2013.01);
(Continued)

(58) Field of Classification Search
CPC ..... F04B 17/05; F04B 39/08; F04B 39/102; F04B 41/02; F04B 49/02; F04B 49/022;
(Continued)

(56) References Cited

U.S. PATENT DOCUMENTS 2,546,613 A 3/1951 Paget
2,725,181 A * 11/1955 Lamberton ..... F04B 25/005 417/243
(Continued)

FOREIGN PATENT DOCUMENTS

JP S56-50747 5/1981
JP 57-038682 3/1982
(Continued)

OTHER PUBLICATIONS

Translation of International Preliminary Report on Patentability and Written Opinion dated Jun. 20, 2013; International Application No. PCT/JP2011/006360; International Filing Date: Nov. 15, 2011.
Nov. 23, 2016 Search Report issued in European Application No. 11847694.4.

*Primary Examiner* — Bryan Lettman
*Assistant Examiner* — Timothy Solak
(74) *Attorney, Agent, or Firm* — Oliff PLC

(57) ABSTRACT

An air compression apparatus includes an air tank, an air compressor, and a governor. The air compressor delivers compressed air to the air tank by using power of an engine at the time of load running and stops the delivery of the compressed air to the air tank at the time of no-load running. The governor switches between the load running and the no-load running of the air compressor. Furthermore, the governor changes, when an engine speed is equal to or more than a threshold value, switchover timing for switching the air compressor from the no-load running to the load running in comparison with a time when the engine speed is less than the threshold value.

2 Claims, 3 Drawing Sheets

(51) Int. Cl.

| | |
|---|---|
| ***F04B 39/10*** | (2006.01) |
| ***F04B 49/24*** | (2006.01) |
| ***F04B 49/02*** | (2006.01) |
| ***F04B 17/05*** | (2006.01) |

(52) U.S. Cl.
CPC ..... *F04B 49/02* (2013.01); *F04B 49/022* (2013.01); *F04B 49/243* (2013.01)

(58) Field of Classification Search
CPC ..... F04B 49/243; F04B 49/03; F04B 49/035; F04B 2201/12; F04B 2201/1201; F04B 2205/08; F04B 2207/044; F04B 2207/0441; F04B 2207/0442
USPC ..... 417/446
See application file for complete search history.

(56) References Cited

U.S. PATENT DOCUMENTS

| | | | | |
|---|---|---|---|---|
| 3,796,515 | A | 3/1974 | Lindqvist et al. | |
| 6,036,449 | A * | 3/2000 | Nishar et al. | 417/292 |
| 2004/0260441 | A1 * | 12/2004 | Dussapt et al. | 701/36 |
| 2006/0196168 | A1 * | 9/2006 | Seitz | B60T 17/02 60/278 |
| 2008/0145241 | A1 * | 6/2008 | Sabelstrom et al. | 417/307 |

FOREIGN PATENT DOCUMENTS

| | | | |
|---|---|---|---|
| JP | S58-14482 | | 1/1983 |
| JP | S63-110682 | | 7/1988 |
| JP | H08-193576 | A | 7/1996 |
| JP | 2000-192886 | | 7/2000 |

* cited by examiner

EMBODIMENT

COMPARATIVE EXAMPLE

AIR COMPRESSOR HAVING MECHANICAL GOVENOR WITH ENGINE SPEED RELIEF

CROSS REFERENCE TO RELATED APPLICATION

This application is a U.S. National Stage application under 35 U.S.C. §371 claiming the benefit of prior filed International Application Number PCT/JP2011/006360, filed Nov. 15, 2011, in which the International Application claims a priority date of Dec. 7, 2010 based on prior filed Japanese Patent Application Number 2010-272370, the entire contents of which are incorporated herein by reference.

TECHNICAL FIELD

The present invention relates to an air compression apparatus.

BACKGROUND ART

Conventionally, an air compressor is mounted as an air source to a vehicle including a truck, in order to feed compressed air to a servo unit or the like of an air brake (refer to, for example, Patent Document 1).

Generally, the air compressor mentioned above is driven by power of an engine of the vehicle, and feeds the compressed air to an air tank at the time of load running. Furthermore, when the compressed air is filled in the air tank, the air compressor is under no load running based on a motion of a governor, and the feed of the compressed air to the air tank is stopped. Accordingly, a consumed horsepower in the air compressor is reduced. Note that a lubrication of the air compressor is carried out by conducting engine oil from the engine.

Patent Document 1: Japanese Unexamined Patent Application Publication No. H08-193576

DISCLOSURE

Problems to be Solved

In the meantime, if the air compressor is switched to a load running when the engine is under high speed rotation, a rapid pressure change is generated at the time of the start of the motion, and there has been room for improvement in that an oil rising amount from the engine to the air compressor is instantaneously increased.

In view of the above-mentioned circumstances, the invention provides a technique of suppressing an oil rising amount from an engine to an air compressor.

Means for Solving the Problems

An air compression apparatus according to an aspect of the present embodiment includes an air tank, an air compressor, and a governor. The air compressor feeds compressed air to the air tank by using power of an engine at the time of load running, e.g. loaded running, and stops the feeding of the compressed air to the air tank at the time of no-load running, e.g. unloaded running. The governor switches between the load running and the no-load running of the air compressor. Furthermore, the governor changes, when an engine speed is equal to or more than a threshold value, switchover timing for switching the air compressor from the no-load running to the load running in comparison with a time when the engine speed is less than the threshold value.

In the air compression apparatus mentioned above, the governor may delay, when the engine speed is equal to or more than the threshold value, the switchover timing in comparison with the time when the engine speed is less than the threshold value. Furthermore, the governor may forcibly switch the air compressor to the load running when pressure of the air tank lowers to a limiting pressure.

Effect

When the engine speed is equal to or more than the threshold value, an oil rising amount from the engine to the air compressor can be further suppressed by changing the switchover timing for switching the air compressor from the no-load running to the load running, in comparison with the time when the engine speed is less than the threshold value.

DETAILED DESCRIPTION OF THE EMBODIMENTS

Description of Embodiment

Figure 1:
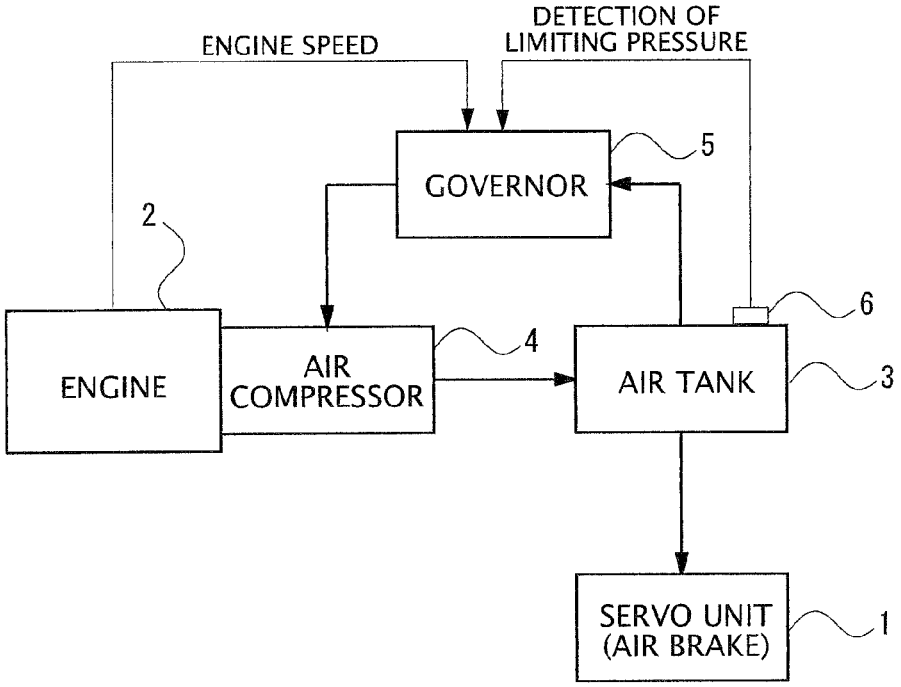
FIG. 1 is a view showing an example of a general configuration of an air compression apparatus according to an embodiment.

FIG. 1 is a view showing an example of a general configuration of an air compression apparatus according to an embodiment. The air compression apparatus according to the embodiment is mounted in a vehicle such as, for example, a truck, and functions as an air source which feeds compressed air to a servo unit 1 of an air brake of a vehicle. Furthermore, the air compression apparatus according to the embodiment carries out compression of air by using a power of an engine 2 of the vehicle.

The air compression apparatus includes an air tank 3, an air compressor 4, and a governor 5.

The air tank 3 reserves the compressed air which is fed from the air compressor 4. An air piping of the air tank 3 is connected to each of the air compressor 4, the servo unit 1 which is a distribution destination of the compressed air, and the governor 5. Note that the air tank 3 includes a detection unit 6 (for example, a pressure sensor) which detects arrival of a limiting pressure on a lower limit side of the air tank 3. The limiting pressure is a pneumatic pressure which can secure a motion of an air brake. In addition, a signal output of the detection unit 6 is connected to the governor 5. Note that, in FIG. 1, the air piping is shown by a thick arrow, and the signal line is shown by a thin arrow.

Figure 2:
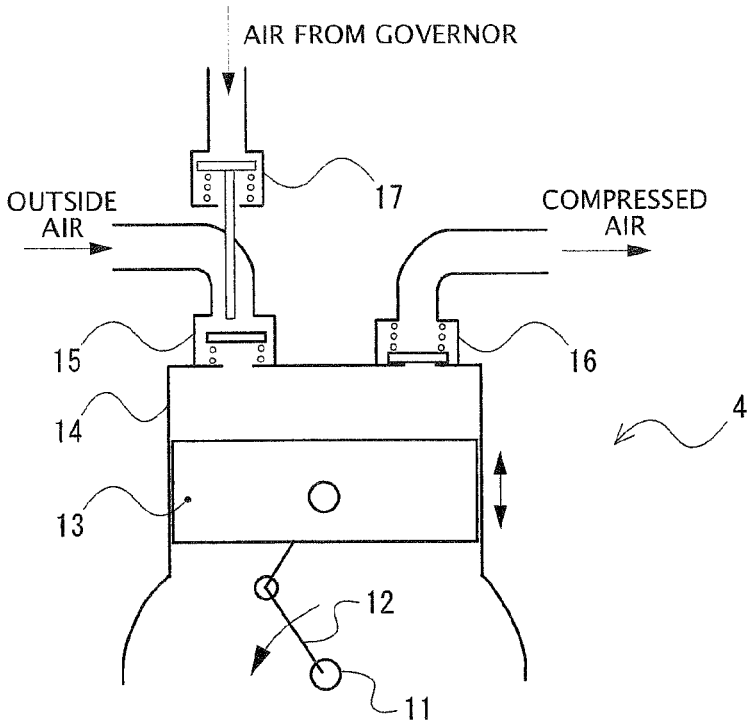
FIG. 2 is a view showing a configuration example of an air compressor.

The air compressor 4 is a piston-type compressor which carries out air compression by the power of the engine 2. FIG. 2 is a view showing a configuration example of the air compressor 4. The air compressor 4 has a crank shaft 11, a piston rod 12, a piston 13, a cylinder 14, an intake valve 15, a discharge valve 16, and an unload valve 17. The crank shaft 11 turns by the power of the engine 2, and moves up and down the piston 13 within the cylinder 14 via the piston rod 12. Furthermore, each of the intake valve 15 and the discharge valve 16 is provided on a top surface of the cylinder 14. Note that the unload valve 17 comes down by being pressed by the air from the governor 5.

Here, when the unload valve 17 does not come down, the air compressor 4 is under load running. At the time of load running, the intake valve 15 is opened and the discharge valve 16 is closed when the piston 13 comes down, and an outside air is sucked into the cylinder 14. Furthermore, when the piston 13 comes up, the intake valve 15 is closed and the discharge valve 16 is opened, and thus the discharged compressed air is fed to the air tank 3.

In contrast, when the unload valve 17 comes down, the air compressor 4 is under no-load running. At the time of no-load running, since the unload valve 17 keeps pushing down the intake valve 15, the air compressor 4 does not carry out the air compression, and the compressed air feed from the air compressor 4 to the air tank 3 is stopped.

Furthermore, a piping distributing engine oil from an oil gallery is connected to the air compressor 4. Moreover, the crank shaft 11 and the piston rod 12 are lubricated by the engine oil (in FIGS. 1 and 2, illustrations of the oil gallery and the piping of the engine oil are both omitted).

Returning to FIG. 1, the governor 5 switches between the load running and the no-load running of the air compressor 4 in accordance with a pneumatic pressure change of the air tank 3.

Figure 3:
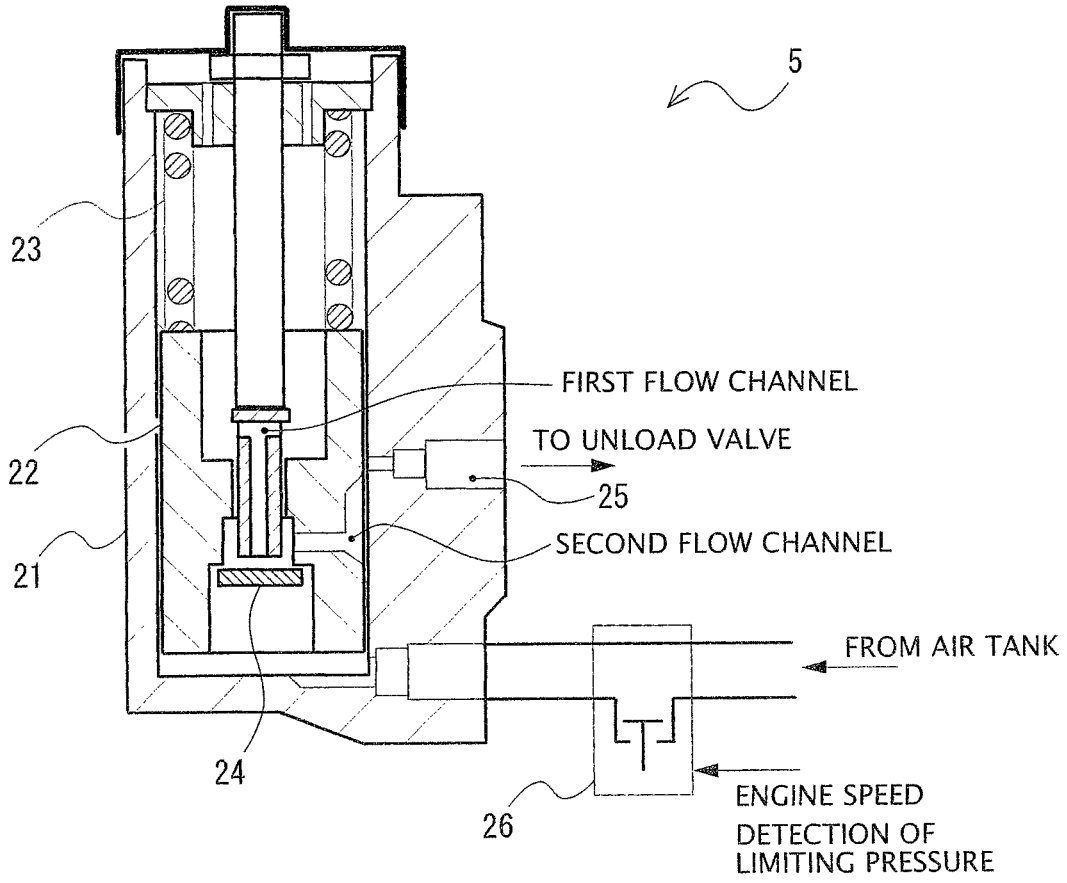
FIG. 3 is a view showing a configuration example of a governor.

FIG. 3 is a view showing a configuration example of the governor 5. The governor 5 has a cylinder 21, a piston 22, and a governor spring 23.

The piston 22 is energized toward a bottom surface of the cylinder 21 by a governor spring 23. Furthermore, the piston 22 has a first flow channel for discharging the air to an atmospheric air, and a second flow channel for guiding the air to a side surface of the piston 22. Moreover, an exhaust valve 24 is provided on a bottom surface side of the piston 22. The exhaust valve 24 opens and closes the first flow channel by moving in a sliding direction of the piston 22.

In addition, the air piping from the air tank 3 is connected to a bottom surface of the cylinder 21 in the governor 5. Furthermore, a side surface of the cylinder 21 is provided with a port 25 for connecting the air piping from the unload valve 17 of the air compressor 4.

Here, when the pneumatic pressure of the air tank 3 reaches a cut-out pressure on a high pressure side, the air pressure on the bottom surface side of the cylinder overcomes the governor spring 23 and the piston 22 is pushed up in the governor 5, whereby the second flow channel of the piston 22 and the port 25 are connected. Furthermore, since the exhaust valve 24 is closed by the air pressure on the bottom surface side of the cylinder, the first flow channel of the piston 22 is closed. Accordingly, since the air in the air tank 3 presses the unload valve 17 of the air compressor 4 to move down, the air compressor 4 is under no-load running.

In contrast, when the pneumatic pressure in the air tank 3 is lowered little by little so as to reach a cut-in pressure on a lower pressure side, the governor spring 23 pushes down the piston 22, and the port 25 is closed by the piston 22. Furthermore, the exhaust valve 24 overcomes the pneumatic pressure on the bottom surface side of the cylinder to be opened, and the first flow channel is opened. Accordingly, since the unload valve 17 of the air compressor 4 is not pressed by the air in the governor 5, the unload valve 17 moves up, and the air compressor 4 is under load running.

Furthermore, the governor 5 according to the embodiment receives an input of the engine speed from the engine 2 via a signal line, and changes a timing (switchover timing) for switching the air compressor 4 from the no-load running to the load running, depending on the engine speed.

As an example, as shown in FIG. 3, a regulating valve 26 which is controlled depending on the engine speed may be provided in the middle of the air piping from the air tank 3. According to an embodiment, when the engine speed is less than a threshold value, the regulating valve 26 is opened and relieves a part of the air from the air tank 3 to the governor 5. In contrast, when the engine speed is high, being equal to or more than the threshold value, the regulating valve 26 may be closed. Accordingly, when the engine 2 is under high speed rotation, the pneumatic pressure on the bottom surface side of the cylinder in the governor 5 becomes relatively higher in comparison with the time when the engine speed is less than the threshold value. As a result, when the engine 2 is under high speed rotation, the unload valve 17 is hard to move up, and the switchover timing to the load running is delayed.

Here, the above-mentioned threshold value defining the time of high speed rotation of the engine 2 may be appropriately regulated in consideration of the type of the engine, a speed increasing ratio between the engine and the air compressor 4, and the like. According to an embodiment, a delay amount of the switchover timing is, for example, approximately between 1 second and 3 seconds.

Furthermore, the above-mentioned regulating valve 26 is opened regardless of the engine speed, depending on the output of the detection unit 6, at the time when the pressure of the air tank 3 reaches the above-mentioned limiting pressure. Accordingly, when the pressure in the air tank 3 is lowered to the limiting pressure, the air compressor 4 can be forcibly switched to the load running, and thus a motion of an air brake can be secured.

Hereinafter, the operation and effect of the air compression apparatus according to an embodiment will be described in comparison with a comparative example.

Figure 5:
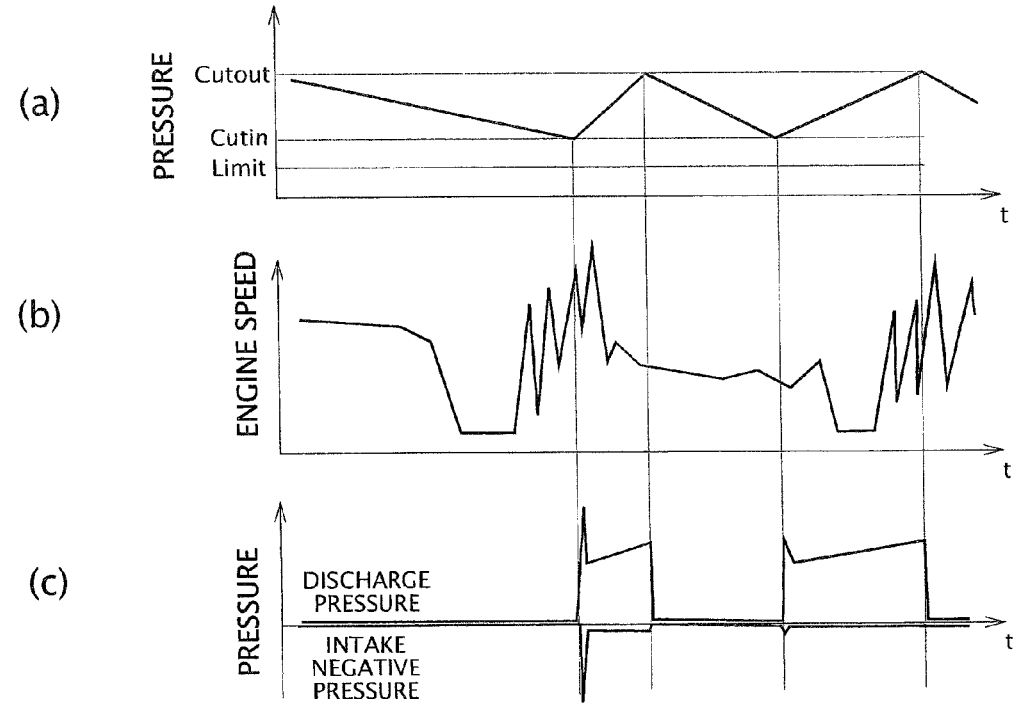
FIGS. 5(*a*) to 5(*c*) are views showing motion examples of a conventional air compression apparatus according to a comparative example.

First, with reference to FIG. 5, an example of a motion of a conventional air compression apparatus which is a comparative example will be described. FIG. 5(*a*) is a view showing a pressure change in an air tank according to the comparative example, in which a vertical axis indicates the pressure and a horizontal axis indicates a time. FIG. 5(*b*) is a view showing a change of an engine speed according to the comparative example, in which a vertical axis indicates the engine speed and a horizontal axis indicates a time. FIG. 5(*c*) is a view showing a change of a discharge pressure and an intake negative pressure in an air compressor according to the comparative example, in which a vertical axis indicates the pressure and a horizontal axis indicates a time.

In the air compression apparatus according to the comparative example, the air compressor is switched to the load running by the cut-in pressure, and the air compressor is switched to the no-load running by the cut-out pressure, without taking the engine speed into consideration (refer to FIGS. 5(*a*) and 5(*b*)). Here, if the air compressor is switched to the load running when the engine speed is high near the peak (for example, immediately before a shift change), values of the discharge pressure and the intake negative pressure of the air compressor become large instantaneously (refer to FIG. 5(*c*)). In the case mentioned above, an amount of the engine oil rising in the piston of the air compressor is instantaneously increased.

Figure 4:
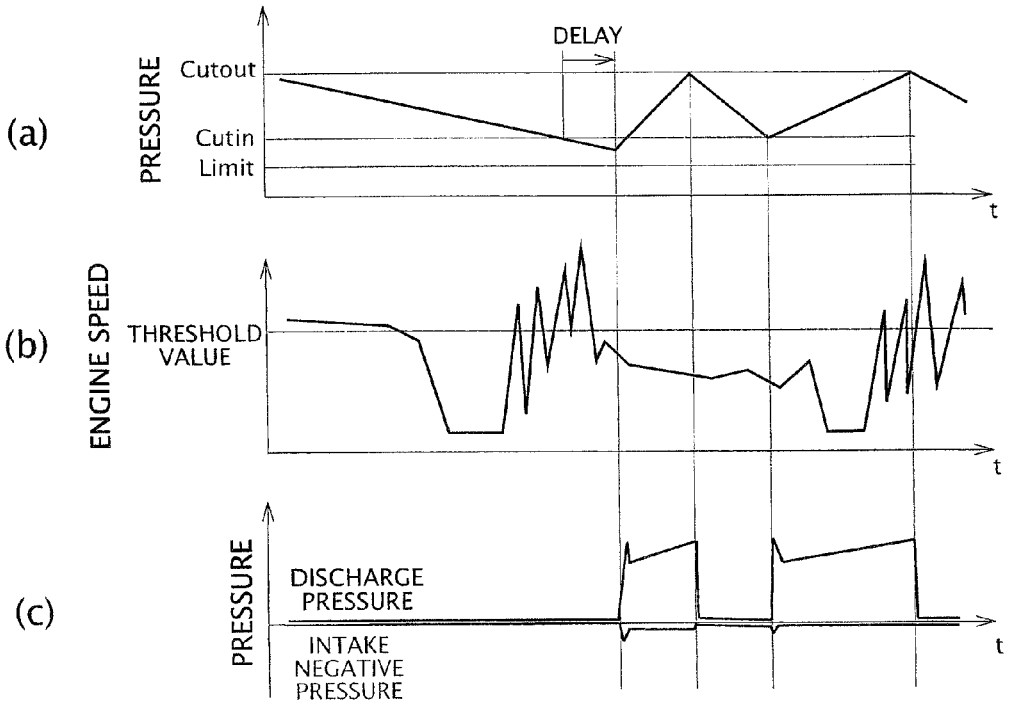
FIGS. 4(*a*) to 4(*c*) are views showing motion examples of an air compression apparatus according to an embodiment.

In contrast, FIG. 4 is a view showing an example of a motion of an air compressor according to an embodiment. FIG. 4(*a*) is a view showing a pressure change in an air tank according to the embodiment, in which a vertical axis indicates the pressure and a horizontal axis indicates a time. FIG. 4(*b*) is a view showing a change of an engine speed according to the embodiment, in which a vertical axis indicates the engine speed and a horizontal axis indicates a time. FIG. 4(*c*) is a view showing a change of a discharge pressure and an intake negative pressure in an air compressor according to the embodiment, in which a vertical axis indicates the pressure and a horizontal axis indicates a time.

In the air compression apparatus according to the embodiment, when the engine speed is high, being equal to or more than a threshold value, a switchover timing for switching the air compressor 4 to the load running is delayed in comparison with the time of reaching the cut-in pressure (refer to FIGS. 4(*a*) and 4(*b*)). Accordingly, in the embodiment, it is possible to cause the air compressor 4 to start feeding of the compressed air in a state of the low engine speed, and the values of the discharge pressure and the intake negative pressure in the air compressor 4 become comparatively small at the time of the start of the load running (refer to FIG. 4(*c*)). Accordingly, in the embodiment, it is possible to effectively suppress an increase of the instantaneous oil rising amount to the air compressor 4.

Modified Example of Embodiment

In the embodiment mentioned above, when the engine speed is equal to or more than the threshold value, there is described the example in which the governor 5 delays the switchover timing of the air compressor 4 to the load running, in comparison with the time of reaching the cut-in pressure. However, in the embodiment mentioned above, when the engine speed is equal to or more than the threshold value, the governor 5 may change the switchover timing of the air compressor 4 to the load running before reaching the cut-in pressure.

In this modified example, the regulating valve 26 may be closed when the engine speed is less than the threshold value, and the regulating valve 26 may be opened when the engine speed is equal to or more than the threshold value. Accordingly, when the engine 2 is under high speed rotation, the pneumatic pressure on the bottom surface side of the cylinder in the governor 5 is relatively lowered in comparison with the time when the engine speed is less than the threshold value. As a result, when the engine 2 is under high speed rotation, the unload valve 17 tends to move up, and the switchover timing to the load running quickens.

According to the above detailed description, features and advantages of the embodiment will be apparent. This intends to make claims cover the features and the advantages of the embodiment as mentioned above within a scope not departing from the sprits and the scope of the present invention. Furthermore, it is perceived that those skilled in the art can easily conceive every improvement and modification, and the present invention is not intended to be limited to the above description of the scope of the embodiment having the inventiveness, but can be based on appropriate improvements and equivalents which are included in the scope disclosed in the embodiment.

The many features and advantages of the embodiment are apparent from the detailed specification and, thus, it is intended by the appended claims to cover all such features and advantages of the embodiment that fall within the true spirit and scope thereof. Further, since numerous modifications and changes will readily occur to those skilled in the art, it is not desired to limit the inventive embodiment to exact construction and operation illustrated and described, and accordingly all suitable modifications and equivalents may be resorted to, falling within the scope thereof.

The invention claimed is:

1. An air compression apparatus comprising:

an air tank;

an air compressor configured to: (i) feed compressed air to the air tank by using power of an engine in a loaded running state of the air compressor, and (ii) stop the feeding of the compressed air to the air tank in an unloaded running state of the air compressor;

a governor configured to switch the air compressor between the loaded running state and the unloaded running state based on a pneumatic pressure at an inlet side of the governor, the inlet side of the governor receiving compressed air from the air tank, and the received compressed air flowing through the governor; and a regulating valve disposed between the air tank and the governor, the regulating value being configured to be in: (i) an open state when a speed of the engine is below a predetermined threshold value such that the regulating valve relieves a portion of the compressed air flowing from the air tank to the governor, and (ii) a closed state when the speed of the engine exceeds the predetermined threshold value, the pneumatic pressure at the inlet side of the governor being greater when the regulating valve is in the closed state than in the open state, wherein the switch by the governor from the unloaded running state to the loaded running state is delayed, based on: (i) the regulating valve being in the open state, in which the regulating valve relieves the portion of the compressed air flowing from the air tank to the governor, and (ii) the air compressor being in the unloaded running state, in which the air compressor stops the feeding of the compressed air to the air tank.

2. The air compression apparatus according to claim 1, wherein the regulating valve switches the air compressor to the loaded running state when a pressure in the air tank decreases to a limiting pressure.

* * * * *